US008596084B2

(12) United States Patent
Herrera et al.

(10) Patent No.: US 8,596,084 B2
(45) Date of Patent: Dec. 3, 2013

(54) ICEMAKER WITH REVERSIBLE THERMOSIPHON

(75) Inventors: Carlos A. Herrera, Fisherville, KY (US); Richard Devos, Goshen, KY (US); Brian Robert Campbell, Louisville, KY (US); Ronald Smith, Louisville, KY (US)

(73) Assignee: General Electric Company, Schenectady, NY (US)

( * ) Notice: Subject to any disclaimer, the term of this patent is extended or adjusted under 35 U.S.C. 154(b) by 570 days.

(21) Appl. No.: 12/857,781

(22) Filed: Aug. 17, 2010

(65) Prior Publication Data

US 2012/0042680 A1 Feb. 23, 2012

(51) Int. Cl.
*F25C 5/08* (2006.01)

(52) U.S. Cl.
USPC ..... 62/351; 62/349

(58) Field of Classification Search
USPC ..... 62/159, 312, 313, 377, 351, 259.2, 420, 62/353, 6; 165/80.3; 249/78–81, 111, 119, 249/127, 203
See application file for complete search history.

(56) References Cited

U.S. PATENT DOCUMENTS

| | | | | |
|---|---|---|---|---|
| 2,117,658 | A | | 5/1938 | Gilliam |
| 2,846,854 | A | | 8/1958 | Galin |
| 3,287,926 | A | | 11/1966 | Hall |
| 3,806,841 | A | * | 4/1974 | Brunner ..... 333/81 R |
| 4,003,214 | A | | 1/1977 | Schumacher |
| 4,233,819 | A | * | 11/1980 | Stottmann ..... 62/349 |
| 4,355,522 | A | | 10/1982 | Gorski et al. |
| 6,223,550 | B1 | | 5/2001 | Marsh et al. |
| 6,658,869 | B1 | | 12/2003 | Thornbrough |
| 7,444,829 | B2 | | 11/2008 | Mori et al. |
| 2006/0086135 | A1 | | 4/2006 | Wu et al. |
| 2006/0266067 | A1 | * | 11/2006 | Anderson et al. ..... 62/340 |
| 2012/0042680 | A1 | | 2/2012 | Herrera et al. |

FOREIGN PATENT DOCUMENTS

| | | | |
|---|---|---|---|
| SU | 1532777 | A1 | 12/1989 |
| WO | 2008061179 | A2 | 5/2008 |

* cited by examiner

*Primary Examiner* — Allen Flanigan
*Assistant Examiner* — Antonio R Febles
(74) *Attorney, Agent, or Firm* — Global Patent Operation; Douglas D. Zhang

(57) ABSTRACT

An apparatus includes a mold body with at least one cavity configured and dimensioned to receive water to be frozen into ice; a hollow sealed tube having an evaporator portion in thermal communication with the mold body and an offset condenser portion opposite the evaporator portion; a two-phase heat transfer fluid contained within the hollow sealed tube; and an actuation arrangement which causes the mold body and the tube to transition between a first position and a second position. In the first position, the water can be introduced into the at least one cavity and the offset condenser portion is above the evaporator portion. In the second position, the ice can be discharged from the at least one cavity and the offset condenser portion is below the evaporator portion. A refrigerator using the apparatus is also disclosed.

27 Claims, 11 Drawing Sheets

ICEMAKER WITH REVERSIBLE THERMOSIPHON

CROSS-REFERENCE TO RELATED APPLICATIONS

This application is related to U.S. patent application Ser. No. 12/857,772, filed on Aug. 17, 2010, entitled MULTI-FUNCTIONAL ROD FOR ICEMAKER, the complete disclosure of which is expressly incorporated herein by reference in its entirety for all purposes.

BACKGROUND OF THE INVENTION

The subject matter disclosed herein relates to refrigeration, and more particularly to icemakers and the like.

It is now common practice in the art of refrigerators to provide an automatic icemaker. The icemaker is often disposed in the freezer compartment and ice is often dispensed through an opening in the access door of the freezer compartment. In this arrangement, ice is formed by freezing water with cold air in the freezer compartment.

BRIEF DESCRIPTION OF THE INVENTION

As described herein, the exemplary embodiments of the present invention overcome one or more disadvantages known in the art.

One aspect of the present invention relates to an apparatus comprising: a mold body with at least one cavity configured and dimensioned to receive water to be frozen into ice; a hollow sealed tube having an evaporator portion in thermal communication with the mold body and an offset condenser portion opposite the evaporator portion; a two-phase heat transfer fluid contained within the hollow sealed tube; and an actuation arrangement which causes the mold body and the tube to transition between a first position and a second position. In the first position, the water can be introduced into the at least one cavity and the offset condenser portion is above the evaporator portion. In the second position, the ice can be discharged from the at least one cavity and the offset condenser portion is below the evaporator portion.

Another aspect relates to a refrigerator comprising: a body defining at least one cooled compartment; a mold body with at least one cavity configured and dimensioned to receive water to be frozen into ice; a hollow sealed tube having an evaporator portion in thermal communication with the mold body and an offset condenser portion, exposed to the at least one cooled compartment, and opposite the evaporator portion; a two-phase heat transfer fluid contained within the hollow sealed tube; and an actuation arrangement, mounted to the body, which causes the mold body and the tube to transition between a first position and a second position. In the first position, the water can be introduced into the at least one cavity and the offset condenser portion is above the evaporator portion. In the second position, the ice can be discharged from the at least one cavity and made accessible to a user of the refrigerator, and the offset condenser portion is below the evaporator portion.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

Figure 3:
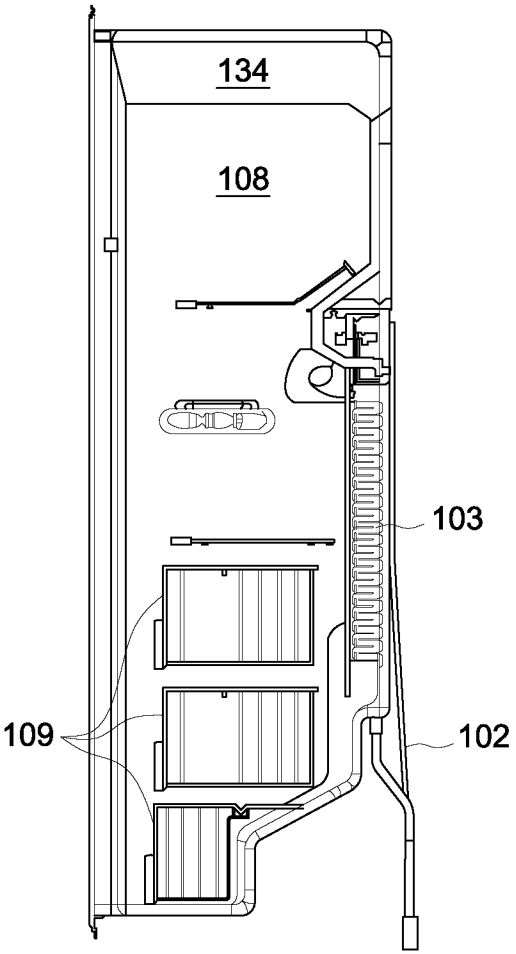
FIG. 3 is a right side cross-sectional view of the freezer compartment of FIG. 1.
Figure 2:
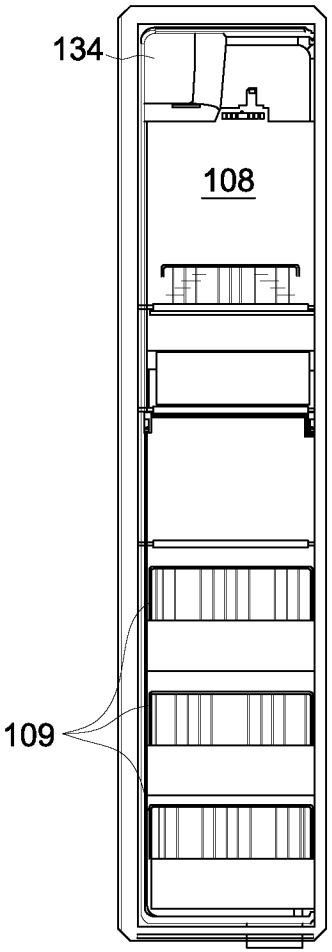
FIG. 2 is a front view of the freezer compartment of FIG. 1, with the compartment door open.
Figure 1:
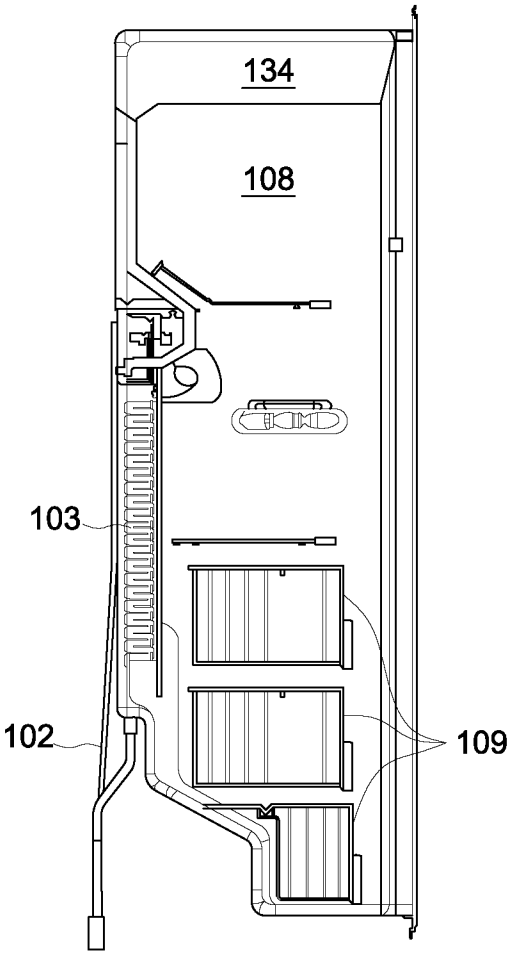
FIG. 1 is a left side cross-sectional view of a freezer compartment of a side-by-side refrigerator, according to an aspect of the invention.

Reference should initially be had to FIGS. 1-3. In one or more embodiments, an icemaker is provided with a reversible thermosiphon, reflux boiler, or heat pipe. Further details are provided below.

FIGS. 1-3 illustrate the freezer compartment 108 of a "side-by-side" refrigerator. The refrigerator is cooled by a conventional vapor-compression mechanical refrigeration cycle (although embodiments could also be used with other types of refrigerators, such as those cooled using thermoelectric cooling, magnetocaloric or absorption systems). The present invention is therefore not intended to be limited to any particular type or configuration of a refrigerator. In a well-known manner, the conventional vapor-compression mechanical refrigeration cycle includes condenser 102 for rejecting heat to ambient and evaporator 103 for absorbing heat from freezer compartment 108 to cool same. Air can pass over evaporator 103 in a conventional fashion. The compressor and expansion valve are omitted but are well known to the skilled artisan.

The freezer compartment 108 and a fresh food compartment (not shown but also well known to the skilled artisan) are arranged in a side-by-side configuration where the freezer compartment 108 is disposed next to the fresh food compartment. The door closing the freezer compartment is omitted in the figures, but can be hinged and sealed to the body in a conventional fashion. Note that embodiments of the invention can also employ installation on the door (not just the cabinet); furthermore, use with configurations other than side-by-side is also possible, such as Bottom Freezer and Top Mount configurations.

The fresh food compartment and the freezer compartment 108 are, in a well-known manner, contained within a main body including an outer case, which can be formed by folding a sheet of a suitable material, such as pre-painted steel, into a generally inverted U-shape to form a top and two sidewalls of the outer case. The outer case also has a bottom which connects the two sidewalls to each other at the bottom edges thereof, and a back. A mullion or divider separates the fresh food compartment from the freezer compartment 108. As is known in the art, a thermally insulating liner is affixed to the outer case.

Suitable racks or shelves 109 are provided within freezer compartment 108 to hold frozen foods or the like. A region 134 is provided within freezer compartment 108 for an ice-maker with a reversible thermosiphon.

As illustrated in FIGS. 4-7, an ice making assembly includes a reversible thermosiphon with evaporator region 142, transport region 143, and condenser region 141 with fins 140. Mold body 104 is provided with a cavity 160 (best seen in FIGS. 6 and 7) to receive water from fill cup 151 to be frozen into ice. Mold body 104 is in thermal communication with evaporator region 142 to aid in rapidly cooling the water in mold body 104.

The aforementioned thermal communication between mold body 104 and evaporator region 142 can be provided in a number of ways. In some instances, best seen in FIGS. 6 and 7, mold body 104 is hollow and includes a hollow interior region 162 containing a suitable working fluid, such as a refrigerant. The thermosiphon is formed from a hollow tube 164, the interior of which is in fluid communication with hollow interior region 162, the two forming a closed system containing the two-phase working fluid. Thus, in this approach, mold body 104 actually comprises at least a portion of the evaporator region 142 and is in thermal communication by virtue of working fluid in hollow interior region 162 evaporating as it absorbs heat from the water in cavity 160, passing through transport region 143, condensing in condenser region 141, and returning to hollow interior region 162 by gravity, in a cycle. The thermosiphon formed by tube 164 and hollow interior region 162 can be filled with working fluid by a suitable charge process.

It should be noted that mold body 104 is depicted in FIGS. 4-7 as a simple single-cavity "egg cup" or "gum drop" for purposes of illustrating aspects of the invention without cluttering the drawings, but preferably has multiple cavities as will be described further below.

Figure 6:
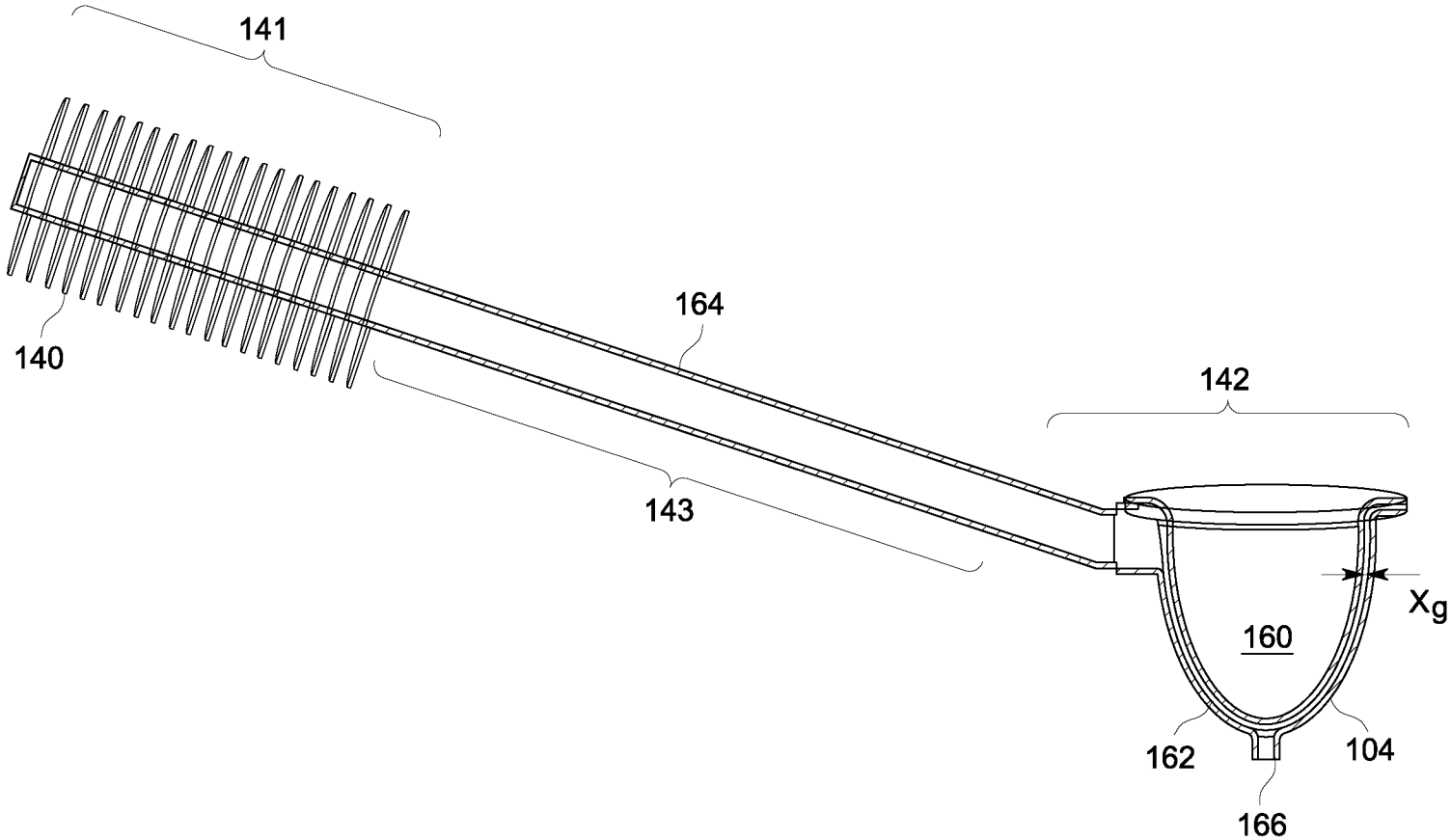
FIG. 6 is a side view of at least a portion of the icemaker with a reversible thermosiphon in FIG. 4, in fill and freeze mode.
Figure 7:
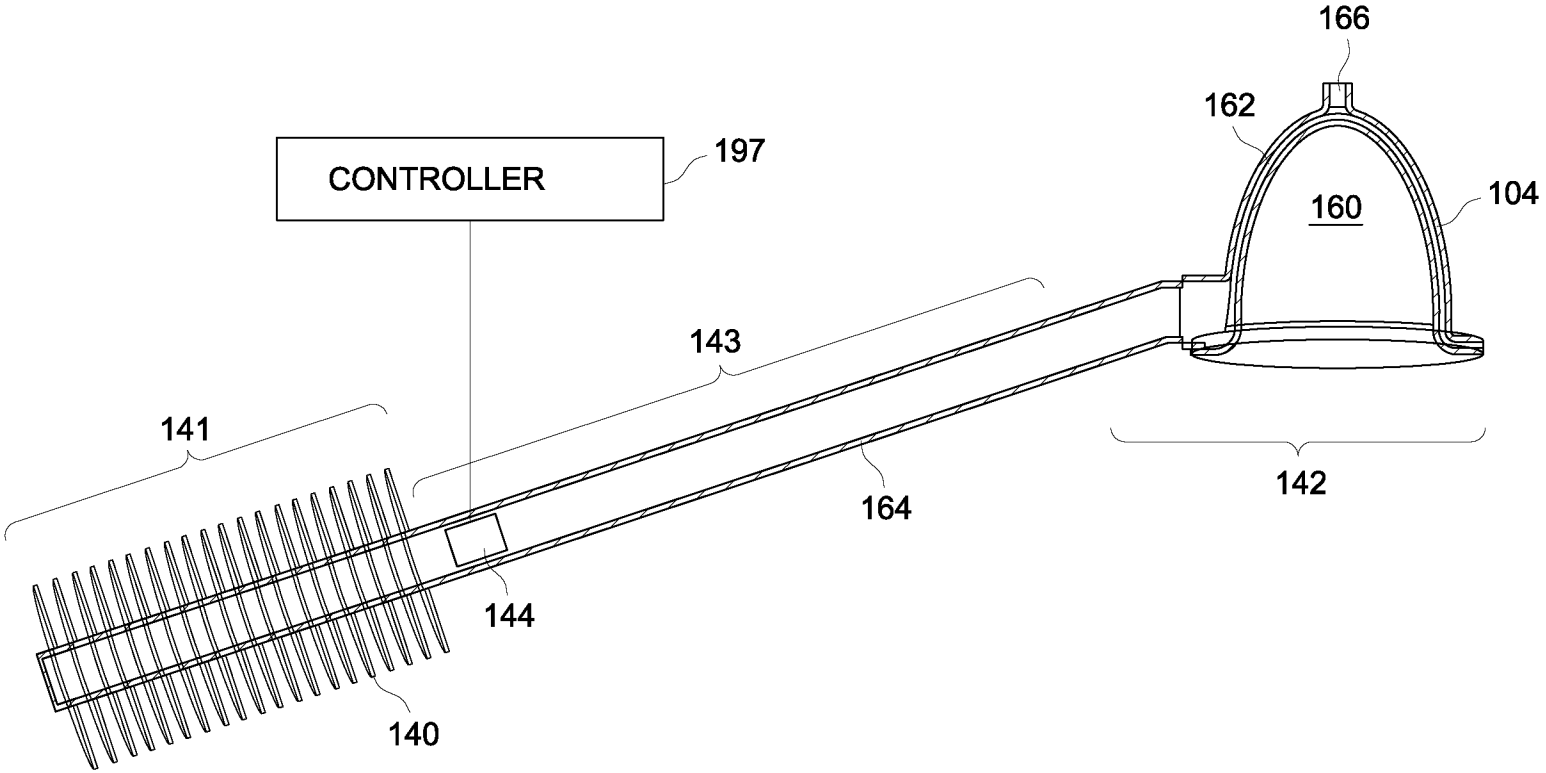
FIG. 7 is a side view of at least a portion of the icemaker with a reversible thermosiphon in FIG. 4, in heat and dispense mode.
Figure 16:
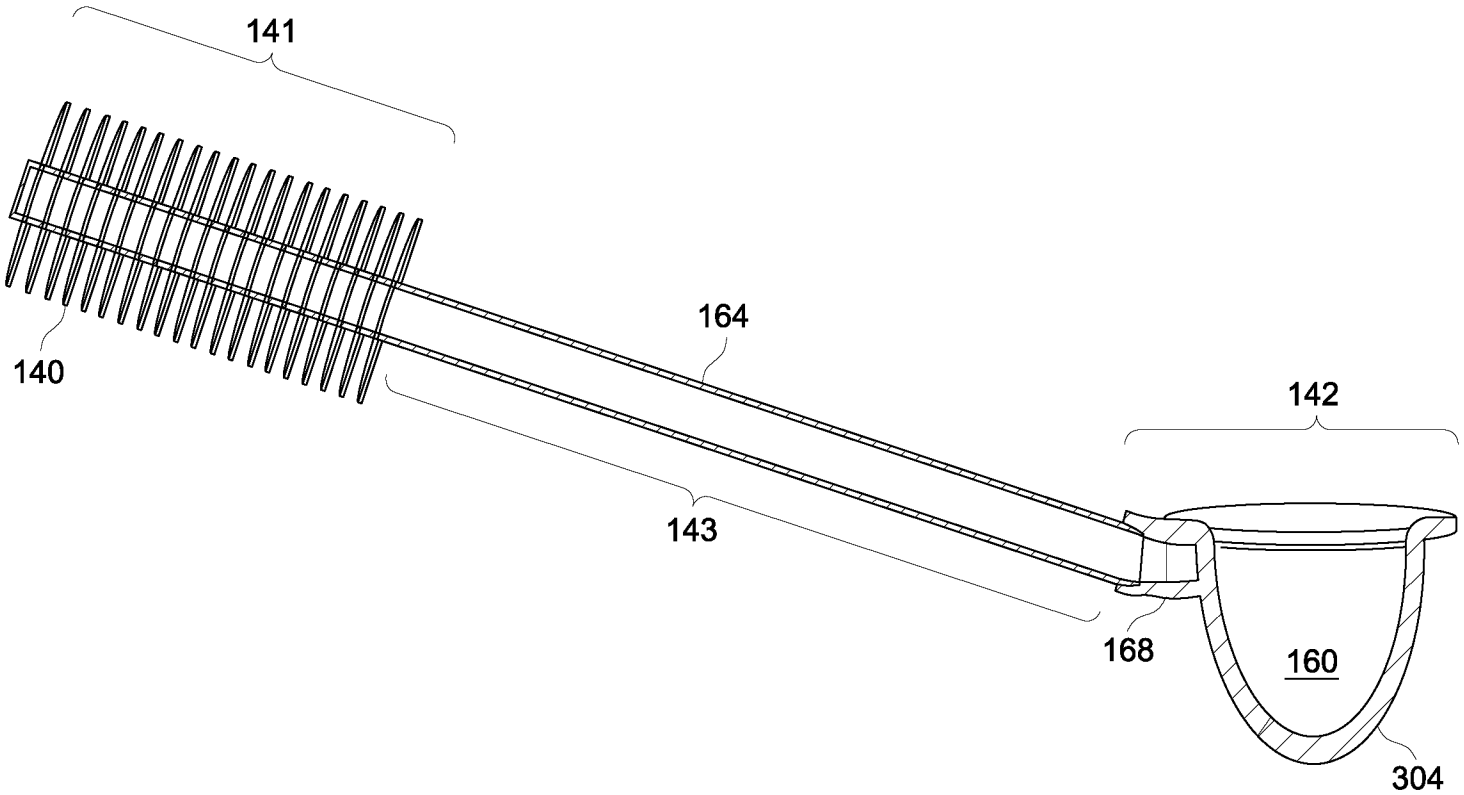
FIG. 16 is view similar to FIG. 6 but of an alternative embodiment with a solid ice mold body portion.

It should also be noted that the arrangement in FIGS. 6 and 7 is but one manner in which thermal communication can be provided between mold body 104 and evaporator region 142. For example, as seen in FIG. 16, mold body 304 may be solid and not contain working fluid, and may be in thermal communication with evaporator region 142 via conduction. In this case, mold body 304 may be made sufficiently thick to provide adequate heat transfer into evaporator region 142 and may be provided with an extended portion 168 in good thermal contact with evaporator region 142.

Figure 17:
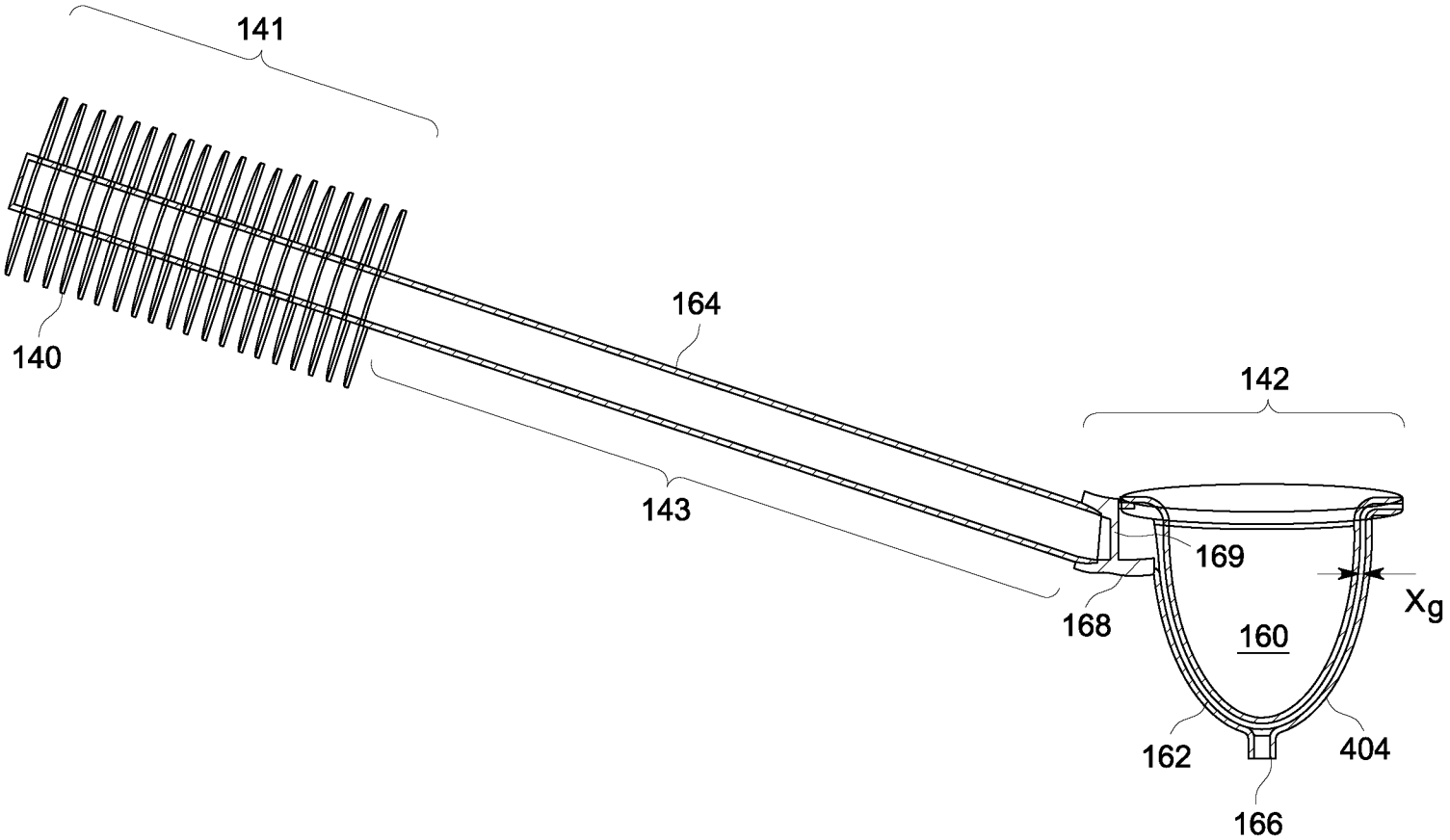
FIG. 17 is view similar to FIG. 6 but of an alternative embodiment with a fluid-filled ice mold body portion not in fluid communication with the reversible thermosiphon.

In another example, as seen in FIG. 17, mold body 404 is hollow and contains working fluid, but is sealed from tube 164 of the reversible thermosiphon via a suitable seal 169. Mold body 404 may be in thermal communication with evaporator region 142 via conduction; again, for example, via extended portion 168 to provide good thermal contact with evaporator region 142. Here, mold body 404 does not need to be made thick because heat transfer is augmented by free convection and/or thermosiphon action in the working fluid in region 162 of mold body 404 (the working fluid in region 162 of mold body 404 could be two-phase or single phase). Thus, some embodiments include two separate thermosiphons; a transport thermosiphon as in FIG. 16, and a mechanical (sealed) interface 169 between the ice mold and transport thermosiphons. The ice mold body 404 is also hollow with working fluid to get supplemental thermal mass. Again, in some instances, the working fluid is single phase with reliance on free convection.

In the alternative embodiment of FIG. 16, pinch or charge tube 166 may be located on hollow tube 164. In the alternative embodiment of FIG. 17, tube 164 and mold 404 may each be provided with a charge tube.

Returning again to FIGS. 4-7, and particularly to FIG. 6, in fill and freeze mode, water is filled into cavity 160 from fill cup 151. Working fluid in hollow interior region 162 evaporates as it absorbs heat from the water in cavity 160, passes through transport region 143, condenses in condenser region 141, and returns to hollow interior region 162 by gravity, in a cycle. Because of this gravity action, a heat pipe with a wicking structure is not necessary, although it could be employed if desired; condenser region 141 must be elevated above evaporator region 142 to aid the gravity return of condensate (unless a wicking structure is provided as in a heat pipe). Heat travels from condenser region 141 into annular fins 140 and then into the chilled air in ice maker region 134 of freezer compartment 108. Other types of extended surfaces besides annular fins could be employed in other embodiments. In some instances, auxiliary cooling may be provided to region 134 to aid ice formation (for example, by blowing air from freezer compartment 108, or a separate evaporator may be employed in the mechanical refrigeration cycle). Where auxiliary cooling is provided, region 134 could even be located in the fresh food compartment, as long as condenser region 141 is exposed to a sufficiently cold ambient to cause freezing of the water in cavity 160.

As seen in FIG. 7, in a heat and dispense mode, the unit is inverted and a heater 144 is activated. The reversible aspect of the thermosiphon will now be described. In this aspect, the condenser region 141 functions as an evaporator and vice versa, that is, working fluid in (nominal) condenser region 141 absorbs heat from heater 144 and evaporates, passes through transport region 143, condenses in (nominal) evaporator region 142, and returns to (nominal) condenser region 141 by gravity, in a cycle. Nominal condenser region 141 (functioning as an evaporator) must be depressed below nominal evaporator region 142 (functioning as a condenser) to aid the gravity return of condensate (unless a wicking structure is provided as in a heat pipe). The condensing working fluid in nominal evaporator region 142 gives up heat to ice in cavity 160 causing peripheral regions thereof to melt sufficiently such that, via gravity, the ice falls out of cavity 160 into a suitable hopper (well known and not separately illustrated), for storage until needed by a user. Such hopper may be in or accessible from the door of the freezer compartment 108 for example.

Note that instead of a side-by-side configuration, the freezer compartment 108 and the fresh food compartment could be arranged in a configuration where the freezer compartment 108 is disposed beneath the fresh food compartment or on top of same.

Figure 4:
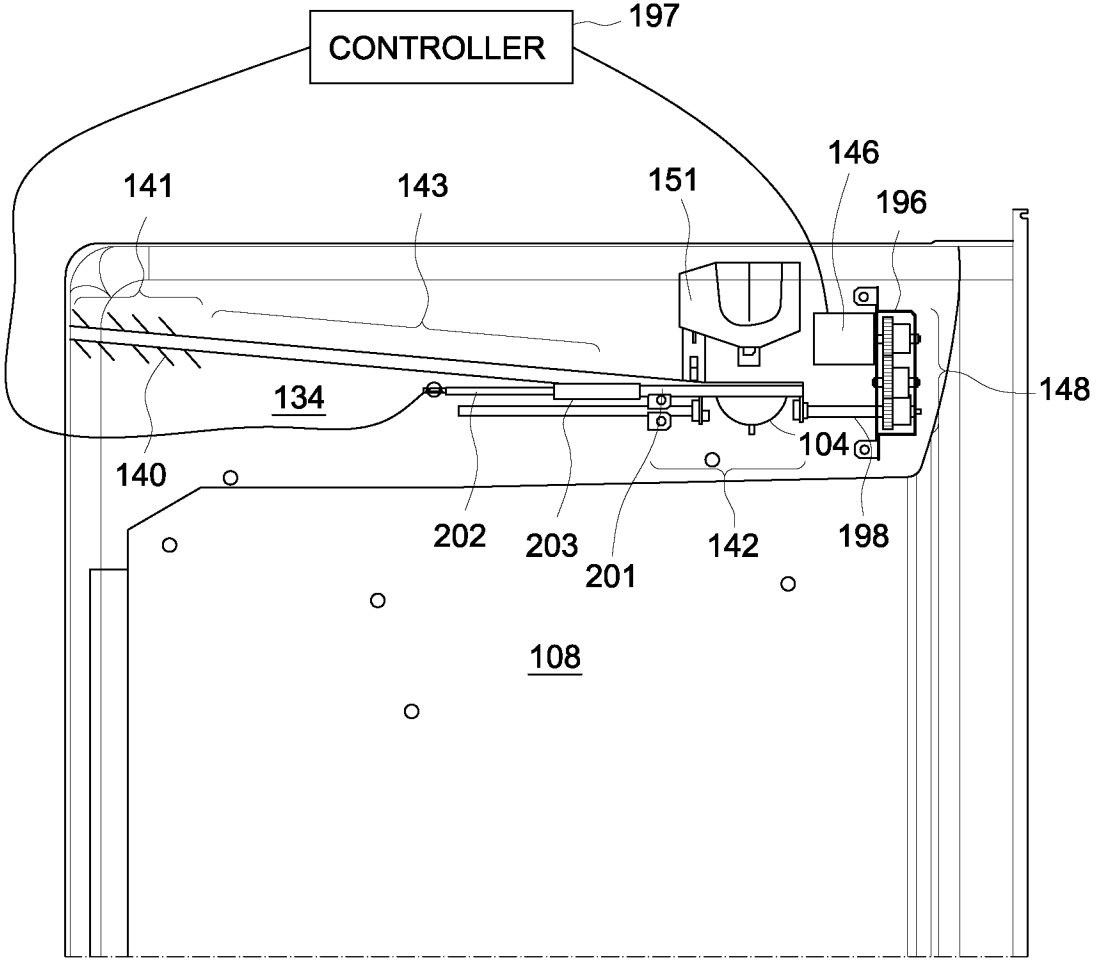
FIG. 4 is a detailed view of the upper portion of FIG. 1, showing an icemaker with a reversible thermosiphon, according to an aspect of the invention.
Figure 5:
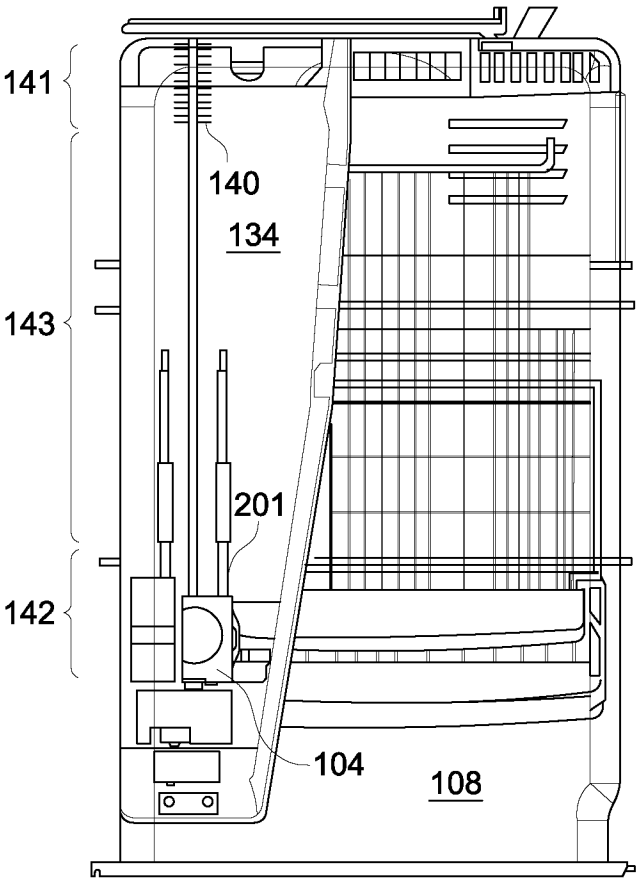
FIG. 5 is a top view of the icemaker with a reversible thermosiphon in FIG. 4.

With continued reference to FIGS. 4 & 5, in order to transition from fill and freeze mode to heat and dispense mode, the assembly is mounted on an axle 198 to which motor 146 is coupled by a suitable gearing arrangement 148. Note mounting bracket 196 to secure the assembly to the wall of the freezer compartment 108. A suitable controller 197 activates motor 146 just long enough to move the assembly back and forth between the fill and dispense modes. Controller 197 also turns heater 144 on and off at appropriate times. Heater 201 is optionally provided for purposes of providing heat directly to the mold body while in the harvest position. Note also the terminals and harness 202, and the heat shrink material 203. In at least some instances, with the fluid in the condenser part of the assembly (during harvest) the heat transfer to the fluid is kept at a minimum.

Any suitable heater 144, 201 can be employed. The heaters 144, 201 can, as noted, also be controlled by the controller 197. One non-limiting example of a suitable heater is the CALROD® line of resistance heating elements available from General Electric Company, Appliance Park, Louisville, Ky. 40225 USA. The heater element 144 can be wrapped around the tube and heat is conducted through a thermal contact interface (the same could be augmented, for example, by soldering, brazing, use of thermally conductive grease or Indium foil, or the like). Mold 104, 304, 404 (discussed below) can, for example, be brazed, soldered, or welded, or in tight mechanical contact, with tube 164. In the embodiment of FIGS. 6 and 7, where there is fluid communication, brazing, soldering, or welding is preferred to ensure fluid tight integrity.

It will thus be appreciated, with reference again to FIGS. 1-3, that ice making assemblies in accordance with one or more embodiments of the invention can be positioned in a variety of locations, which may be similar to the positions of ice making assemblies on current refrigerators. These include, for example, the top corner of the freezer compartment, within the fresh food or freezer compartment doors, and so on. The footprint of ice making assemblies in accordance with one or more embodiments of the invention can, in at least some instances, be similar to those of current ice makers. The condenser 141 should be in an environment with a temperature sufficiently low to freeze water into ice at ambient pressure, such as the ambient air in the freezer compartment or separate ice making region.

Figure 8:
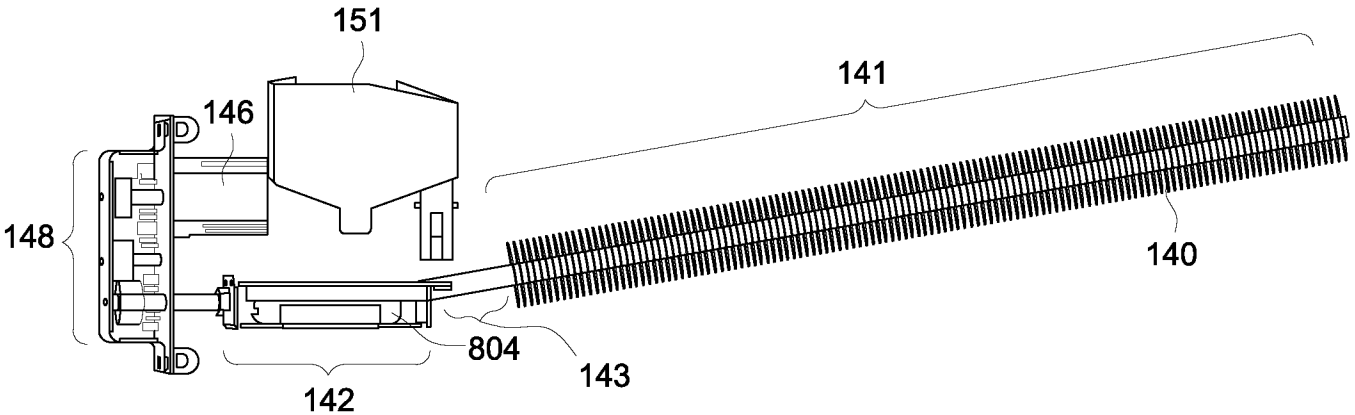
FIG. 8 is a side view of an alternative embodiment of an icemaker with a reversible thermosiphon, in fill and freeze mode, according to an aspect of the invention.
Figure 9:
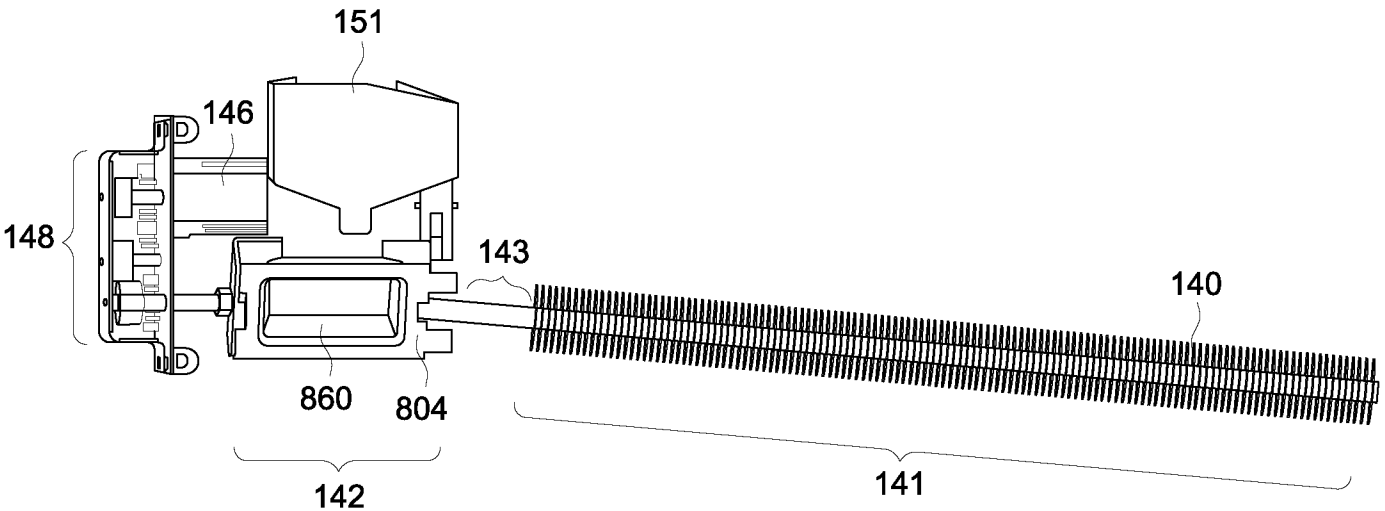
FIG. 9 is a side view of the alternative embodiment of FIG. 8, in heat and dispense mode.

FIGS. 8 and 9 depict an alternative embodiment in fill and freeze mode and heat and dispense mode, respectively. Elements similar to those already described have received the same reference character. Here, ice mold body 804 is provided with a cavity 860 in the shape of a shallow rectangular prism or tray with rounded edges and corners. The heater and controller are omitted but could function as described above. Cavity 860 could, in at least some cases, be provided with dividers to form individual cubes. Many alternative forms of ice mold bodies are possible. For example, with reference to FIGS. 14 and 15, ice mold body 1404 is provided with a plurality of gumdrop-shaped cavities 160 (six are shown in the example but any desired number can be provided). Bodies 804, 1404 are hollow and filled with working fluid in communication with tube 164, but could equally be solid or filled with working fluid not in communication with tube 164, as described above with respect to FIGS. 16 and 17.

The working fluid in all embodiments is generally pressurized. The mold and thermosiphon components are preferably made of a metal with good thermal conductivity. Given the teachings herein, the skilled artisan can structurally design the portions containing refrigerant using known techniques for designing pressure vessels.

One advantage that may be realized in the practice of some embodiments of the described systems and techniques is a very high ice rate. Another advantage that may be realized in the practice of some embodiments of the described systems and techniques is low energy use. Still another advantage that may be realized in the practice of some embodiments of the described systems and techniques is lighter weight and/or lower cost. Yet another advantage that may be realized in the practice of some embodiments of the described systems and techniques is fast thermal response due to low thermal mass.

It will thus be appreciated that in one or more embodiments, an icemaker that uses a thermosiphon or heat pipe to transfer heat away from water to cool and make ice, and also, when inverted, to heat the surface of the ice to release the ice from the mold. Heat pipes transfer heat with negligible resistance to heat transfer when compared to conduction; both ends are always at almost the same temperature due to the two-phase working fluid. A heat pipe is a tube that has liquid and vapor refrigerant at a uniform pressure. When the heat is applied to the bottom liquid, it boils and condenses on the top. This configuration is also called a thermosiphon since the liquid is moved to the evaporator by gravity. The thermosiphon evaporator and condenser are reversible in this application thanks to the ability for the mold body to rotate, thus allowing the working fluid to move from one end to the other. During ice making, the working fluid is in the mold body removing heat from the water. During harvesting the assembly rotates and the working fluid moves to the end of the pipe with fins, where a heater boils the refrigerant which condenses on the mold body releasing the ice with even heat distribution.

In one or more embodiments, a stamped mold body made from thin material can be employed (for example, those where the mold body contains working fluid), resulting in cost savings and efficiency improvement. This is possible since the heat is conducted through the thickness of the body instead of conduction along the length of the mold body. Conduction along the length is a slower and less efficient process. Additionally the ability to reverse the thermosiphon allows for a very fast and efficient release of the ice into the bucket or hopper. In some instances, the mold body is also an integral part of the thermosiphon which improves thermal conductivity for both cooling and harvesting. Purely by way of a non-limiting example, mold body thicknesses in the 0.060" range have been tested and found to work acceptably; furthermore, also purely by way of a non-limiting example, wattages for the heater were tested at 100 W with a relatively short "ON" time cycle.

In some instances, such as FIG. 17, heat pipes are used in two separate and independent applications to the icemaker. The first heat pipe cools the mold body, increasing the rate of ice cooling. The second heat pipe (or possibly a single phase fluid) heats the surface of the mold body to increase the rate of melting of the ice surface, allowing the removal of the cubes more quickly. The second heat pipe is integrated in the mold body providing uniform heat to the surface of the cube, resulting in near-instantaneous release of the cube from the mold.

One or more embodiments thus permit more rapidly making ice, providing a high rate of heat transfer from the water to be frozen into the environment (i.e., freezer or dedicated ice making space). The evaporator portion of the thermosiphon is in thermal communication with the mold body and thus with the water to be frozen, while the condenser portion of the thermosiphon is in thermal communication with the freezer space. Use of a heat pipe, thermosiphon or reflux boiler dramatically increases heat transfer as compared to standard conduction and convection.

A variety of working fluids are possibly, depending on where it is desired to have the refrigerant boil. The system can use, by way of example and not limitation, propane (R-290), R600a (isobutane), and R-134a. These are the American Society of Heating, Refrigerating, and Air Conditioning Engineers (ASHRAE) designations, and are in themselves well known to the skilled artisan who, given the teachings herein, will be able to select appropriate refrigerants for use with one or more embodiments. Boiling points can be chosen based on operating temperature and pressure. These will vary from application to application. Refrigerant data is available from ASHRAE or the National Institute of Standards and Technology (NIST).

Figure 10:
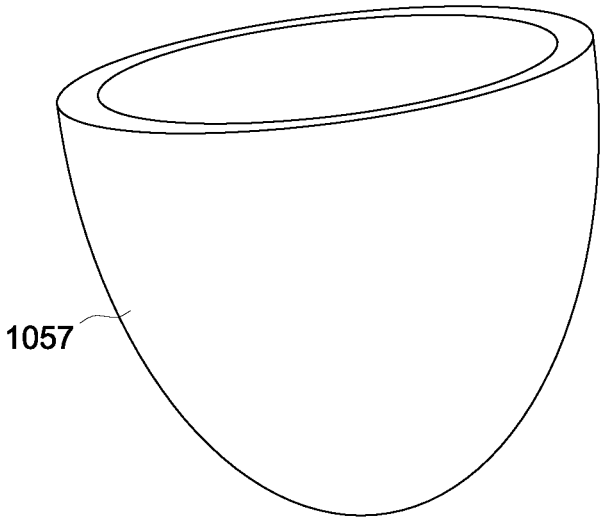
FIGS. 10 and 11 show exemplary non-limiting details of the ice mold of the embodiments of FIGS. 4-7, FIG. 11 being the mold shell and FIG. 10 the corresponding fluid volume.
Figure 11:
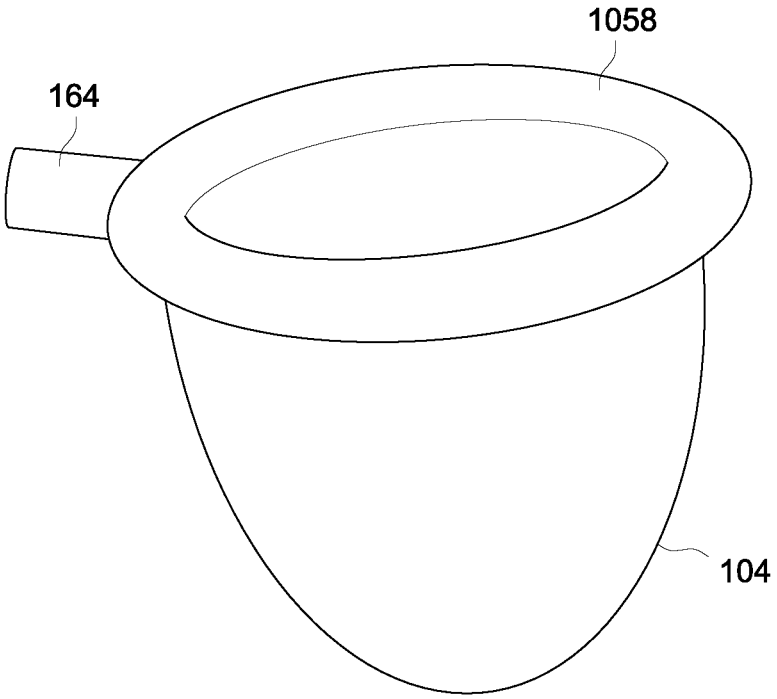

FIG. 11 shows an exemplary "egg cup" or "gum drop" ice mold 104 and FIG. 10 shows, as a solid model, the corresponding fluid volume 1057 within mold 104. Note that mold 104 may be provided with a hollow lip 1058 to provide fluid communication with tube 164. Lip 1058 can be provided in one or more embodiments as a "doughnut" type continuation of the tube 164 into the mold 104; its purpose is to reduce the velocity of the refrigerant vapor by providing a larger volume than that of the hollow interior region (such as 162) per se. When condensing, lip 1058 helps ensure that the fluid flows to the bottom of the cavity and does not stay on the top of the mold due to capillary effects; also, lip 1058 helps ensure that once fluid boils not a lot of fluid is entrained towards the condenser by bubbles before it has a chance to flash. FIG. 11 is also representative of the total refrigerant volume of the mold while FIG. 10 corresponds to the refrigerant volume in the portion of the mold which contacts the water to be frozen into ice. In a non-limiting example, this latter refrigerant volume is about 0.213 cubic inches, corresponding to a mass of R-290 of 1.9 grams or 2.1 grams of R-600-a. Furthermore, in a non-limiting example, the total refrigerant volume of the mold is about 0.352 cubic inches, corresponding to a mass of R-290 of 3.2 grams or 3.5 grams of R-600-a.

Figure 12:
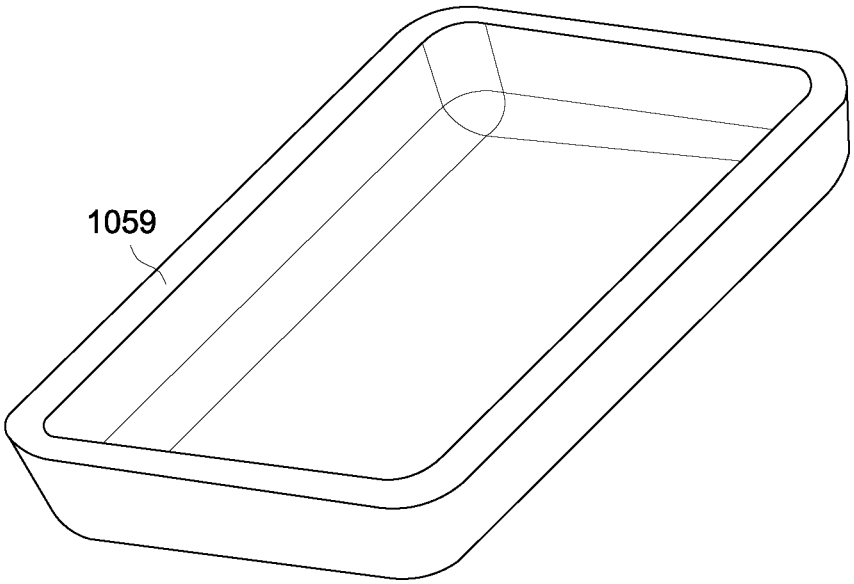
FIGS. 12 and 13 show exemplary non-limiting details of the refrigerant volume of the ice mold of the embodiments of FIGS. 8 and 9, FIG. 13 being the mold shell and FIG. 12 the corresponding fluid volume.
Figure 13:
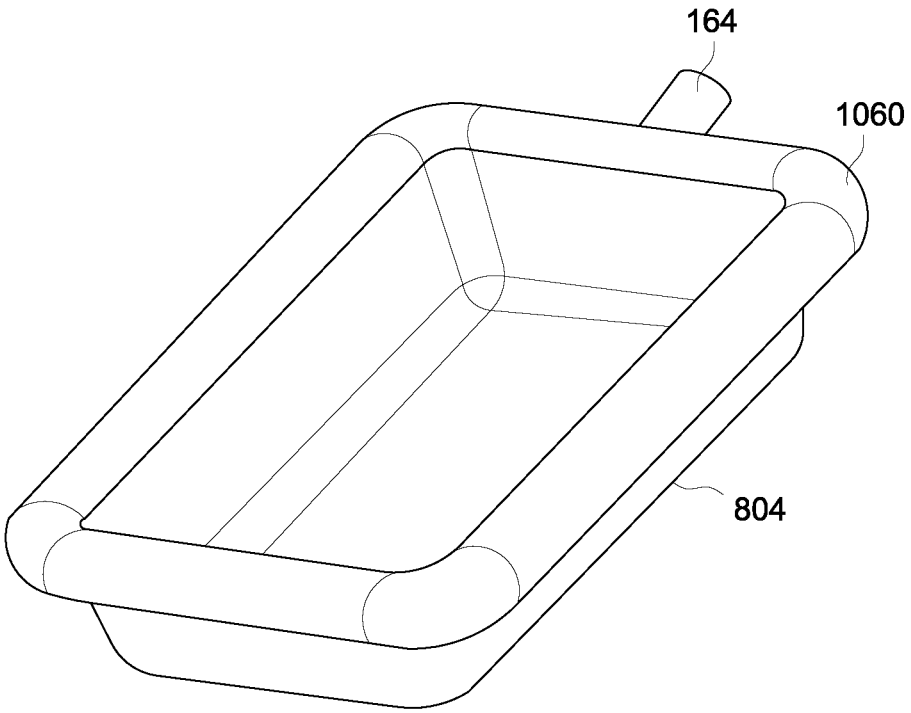

FIG. 13 shows an exemplary rectangular prism ice mold 804 and FIG. 12 shows, as a solid model, the corresponding fluid volume 1059 within mold 804. Note that mold 804 may also be provided with a hollow lip 1060 to provide fluid communication with tube 164. FIG. 13 is also representative of the total refrigerant volume of the mold while FIG. 12 corresponds to the refrigerant volume in the portion of the mold which contacts the water to be frozen into ice. In a non-limiting example, this latter refrigerant volume is about 0.274 cubic inches, corresponding to a mass of R-290 of 2.5 grams or 2.7 grams of R-600-a. Furthermore, in a non-limiting example, the total refrigerant volume of the mold is about 0.5606 cubic inches as calculated from a solid model or about 0.52 cubic inches as measured, corresponding to a mass of R-290 of 5.1 grams or 5.5 grams of R-600-a.

In one or more embodiments, the gap thickness $x_g$ between the walls of the hollow ice mold is about 0.080 inches, as seen in FIGS. 6 & 17. The skilled artisan will be able to extrapolate the data discussed above for other configurations, such as those with multiple cavities 160. In some instances, surface enhancements can be employed to increase the heat transfer coefficient during boiling. This may include, for example, a sandblasted surface that provides micro-cavities for nucleate boiling; grooves, sintering and other surface heat transfer enhancement techniques may be also used.

In one non-limiting example, improvements on the order of about 40-50% were noted in the time to freeze a set volume of water when using a thermosiphon arrangement where the mold body functioned as an evaporator, as compared to a case where fins 140 were insulated to block the thermosiphon action. An aspect of this test was to isolate the effects of the phase change of the working fluid. When the condenser portion was insulated, there was no efficient heat rejection and condensation of the working fluid, thus eliminating the rapid heat transfer benefit obtained by using a thermosiphon. Other embodiments may note similar or different results, depending, for example, on the temperature differentials and air flow velocities. With regard to this latter aspect, one significant factor in accelerating heat transfer rate is to increase air velocity on the heat exchanger; in some instances, forced convection can be provided by the freezer evaporator fan (or another fan). However, forced convection is optional and not required, since a significant contributor to the rapid heat transfer is the additional surface compared to a conventional ice making system, which can provide significant improvements even in the case of free convection.

Given the discussions thus far, it will be appreciated that, in general terms, an exemplary apparatus, according to one aspect of the invention, includes a mold body 104, 304, 404, 804, 1404 with at least one cavity 160, 860 configured and dimensioned to receive water to be frozen into ice. The apparatus also includes a hollow sealed tube 164 having an evaporator portion 142 in thermal communication with the mold body and an offset condenser portion 141 opposite the evaporator portion. A "tube" should be broadly construed to encompass any hollow pressure vessel that can function as a thermosiphon as described herein. "Offset" means arrange such that upon rotation or other activation, the relative vertical positions of the evaporator and condenser can change. "Sealed" includes being sealed in and of itself, as in FIGS. 16 and 17, as well as being sealed in fluid communication with the mold body, as in FIGS. 6 and 7.

The apparatus also includes a two-phase heat transfer fluid (working fluid) contained within the hollow sealed tube, and an actuation arrangement which causes the mold body and the tube to transition between first and second positions. A non-limiting example of an actuation arrangement includes motor 146 with gearing arrangement 148 and a suitable axle or the like, mounting bracket or the like, and so on. In the first position, as, for example, in FIGS. 6, 8, 14, 16, and 17, the water can be introduced into the at least one cavity and the offset condenser portion is above the evaporator portion. In the second position, such as in FIGS. 7, 9, and 15, the ice can be discharged from the at least one cavity and the offset condenser portion is below the evaporator portion.

It is preferred that a heater 144 be provided in thermal communication with the condenser portion.

In at least some instances, a controller 197 is configured to cause the actuation arrangement to transition the mold body and the tube between the first and second positions and/or to activate the heater when the mold body and the tube are in the second position.

The condenser portion 141 is preferably equipped with an augmented heat transfer surface, such as annular fins 140.

Figure 14:
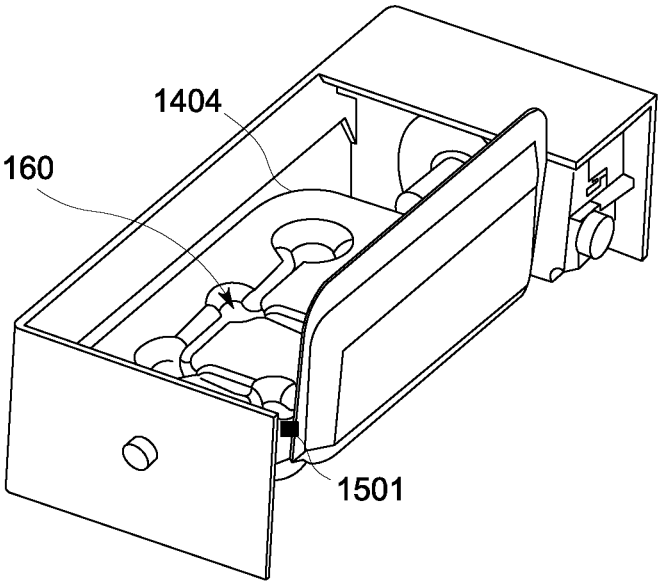
FIG. 14 shows an ice mold body portion of an icemaker with a reversible thermosiphon, in fill and freeze mode, according to an aspect of the invention.
Figure 15:
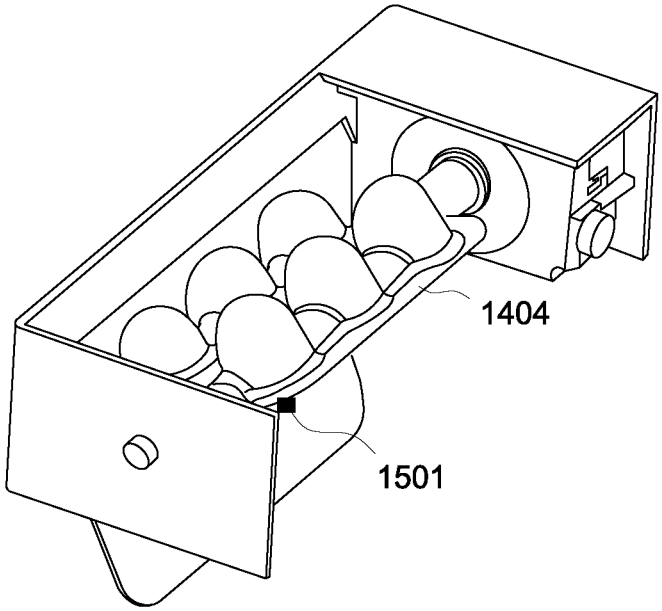
FIG. 15 shows the ice mold body portion of FIG. 14, in heat and dispense mode.

In some instances, such as in FIGS. 14 and 15, the mold body has a plurality of cavities 160 configured and dimensioned to receive water to be frozen into ice.

As noted, there are many different ways in which evaporator portion 142 can be placed in thermal communication with the mold body 104, 304, 404, 804, 1204. For example, in some instances, such as best seen in FIGS. 6 and 7, the mold body 104 is hollow and in fluid communication with the hollow sealed tube 164, with the two-phase heat transfer fluid extending into the hollow mold body, and the evaporator portion of the hollow tube in thermal communication with the mold body via the fluid communication (in essence, the end of the tube and the hollow mold body cooperatively form the evaporator). In some instances, the hollow mold body is formed by spaced apart walls. The refrigerant flow and heat transfer between the walls can be enhanced by the increased velocity that results from appropriate spacing. In a non-limiting example, a 0.080" gap was used.

In other cases, such as FIG. 16, the evaporator portion of the hollow tube is in thermal communication with the mold body via conduction.

In some instances, as described above, a hollow lip-like plenum 1058, 1060 is provided on the mold body about the at least one cavity. The hollow lip-like plenum provides the fluid communication between the hollow sealed tube and the hollow mold body, and is configured and dimensioned to reduce velocity of the heat transfer fluid (i.e., as compared to a case where the internal working fluid volume of the ice mold body interfaced directly with the tube).

Fill cup 151 can be positioned adjacent the at least one cavity of the mold body in the first position to dispense the water thereto.

As noted, non-limiting examples of the working fluid include propane, isobutane, and R-134a.

In some instances, referring back to FIGS. 14 and 15, techniques other than heating can be used to help remove the ice from the mold (or such techniques could be used together with heating). One possibility is to twist the mold with a twist-inducing member; for example, a stop 1501. This stop can be located, for example, on the opposite side of the mold body from the motor and gearing, and can interfere with the corner of the mold when the mold is inverted, as in FIG. 15, causing the mold to experience a torque and subsequent twisting. The stop could be made, for example, of an elastomeric material to provide twisting without undue shock loading.

Furthermore, given the discussion thus far, it will be appreciated that, in general terms, an exemplary refrigerator according to still another aspect of the invention, includes a body defining at least one cooled compartment (e.g., 108, 134); and an apparatus as described above, with the condenser 141 exposed to the cooled compartment. The aforementioned actuation arrangement can be mounted to the body of the refrigerator, directly, or indirectly (for example, via a door, mullion, divider, internal wall, intermediate bracketing, or the like). As used herein, including the claims, mounting of the actuation arrangement to the body of the refrigerator is included to encompass both direct and indirect mounting, unless expressly stated otherwise.

Software includes but is not limited to firmware, resident software, microcode, etc. As is known in the art, part or all of one or more aspects of the methods and apparatus discussed herein may be distributed as an article of manufacture that itself comprises a tangible computer readable recordable storage medium having computer readable code means embodied thereon. The computer readable program code means is operable, in conjunction with a computer system or microprocessor, to carry out all or some of the steps to perform the methods or create the apparatuses discussed herein. A computer-usable medium may, in general, be a recordable medium (e.g., floppy disks, hard drives, compact disks, EEPROMs, or memory cards) or may be a transmission medium (e.g., a network comprising fiber-optics, the worldwide web, cables, or a wireless channel using time-division multiple access, code-division multiple access, or other radio-frequency channel). Any medium known or developed that can store information suitable for use with a computer system may be used. The computer-readable code means is any mechanism for allowing a computer or processor to read instructions and data, such as magnetic variations on a magnetic medium or height variations on the surface of a compact disk. The medium can be distributed on multiple physical devices (or over multiple networks). As used herein, a tangible computer-readable recordable storage medium is intended to encompass a recordable medium, examples of which are set forth above, but is not intended to encompass a transmission medium or disembodied signal. A processor may include and/or be coupled to a suitable memory. A processor with suitable software and/or firmware instructions may be used to implement controller 197. Other types of controls, such as electromechanical controls, could also be used.

Thus, while there have shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An apparatus comprising:

a mold body with at least one cavity configured and dimensioned to receive water to be frozen into ice;

a hollow tube comprising:

an evaporator portion proximate an open end of said hollow tube, said evaporator portion being in thermal communication with said mold body; and an offset condenser portion proximate a closed distal end of said hollow tube opposite said open end;

a two-phase heat transfer fluid contained within said hollow tube; and an actuation arrangement which causes said mold body and said tube to transition between:

a first position wherein said water can be introduced into said at least one cavity and wherein said offset condenser portion is above said evaporator portion; and a second position wherein said ice can be discharged from said at least one cavity and wherein said offset condenser portion is below said evaporator portion.

2. The apparatus of claim 1, further comprising a heater in thermal communication with said condenser portion.

3. The apparatus of claim 2, further comprising a controller configured to cause said actuation arrangement to transition said mold body and said tube between said first and second positions and to activate said heater when said mold body and said tube are in said second position.

4. The apparatus of claim 3, wherein said condenser portion is equipped with an augmented heat transfer surface.

5. The apparatus of claim 4, wherein said augmented heat transfer surface comprises a plurality of annular fins.

6. The apparatus of claim 3, wherein said mold body has a plurality of cavities configured and dimensioned to receive said water to be frozen into said ice.

7. The apparatus of claim 3, wherein:

said mold body is hollow and in fluid communication with said hollow tube, said two-phase heat transfer fluid extending into said hollow mold body, said evaporator portion of said hollow tube being in said thermal communication with said mold body via said fluid communication.

8. The apparatus of claim 7, further comprising a hollow lip-like plenum on said mold body about said at least one cavity, said hollow lip-like plenum providing said fluid communication between said hollow tube and said hollow mold body, said hollow lip-like plenum being configured and dimensioned reduce velocity of said heat transfer fluid.

9. The apparatus of claim 7, wherein said hollow mold body is formed by walls spaced apart by a distance so as to enhance refrigerant flow and heat transfer by increased working fluid velocity.

10. The apparatus of claim 3, wherein:

said evaporator portion of said hollow tube is in said thermal communication with said mold body via conduction.

11. The apparatus of claim 3, further comprising a fill cup positioned adjacent said at least one cavity of said mold body in said first position to dispense said water thereto.

12. The apparatus of claim 3, wherein said heat transfer fluid comprises one of propane, isobutane, and R-134a.

13. The apparatus of claim 1, further comprising a member which causes said mold body to twist to aid in said discharge of said ice from said at least one cavity.

14. A refrigerator comprising:

a body defining at least one cooled compartment;

a mold body with at least one cavity configured and dimensioned to receive water to be frozen into ice;

a hollow tube comprising:

an evaporator portion proximate an open end of said hollow tube, said evaporator portion being in thermal communication with said mold body and an offset condenser portion, exposed to said at least one cooled compartment, proximate a closed distal end of said hollow tube opposite said open end;

a two-phase heat transfer fluid contained within said hollow tube; and an actuation arrangement, mounted to said body, which causes said mold body and said tube to transition between:

a first position wherein said water can be introduced into said at least one cavity and wherein said offset condenser portion is above said evaporator portion; and a second position wherein said ice can be discharged from said at least one cavity and made accessible to a user of said refrigerator, and wherein said offset condenser portion is below said evaporator portion.

15. The refrigerator of claim 14, further comprising a heater in thermal communication with said condenser portion.

16. The refrigerator of claim 15, further comprising a controller configured to cause said actuation arrangement to transition said mold body and said tube between said first and second positions and to activate said heater when said mold body and said tube are in said second position.

17. The refrigerator of claim 16, wherein said condenser portion is equipped with an augmented heat transfer surface.

18. The refrigerator of claim 17, wherein said augmented heat transfer surface comprises a plurality of annular fins.

19. The refrigerator of claim 16, wherein said mold body has a plurality of cavities configured and dimensioned to receive said water to be frozen into said ice.

20. The refrigerator of claim 16, wherein:

said mold body is hollow and in fluid communication with said hollow tube, said two-phase heat transfer fluid extending into said hollow mold body, said evaporator portion of said hollow tube being in said thermal communication with said mold body via said fluid communication.

21. The refrigerator of claim 20, further comprising a hollow lip-like plenum on said mold body about said at least one cavity, said hollow lip-like plenum providing said fluid communication between said hollow tube and said hollow mold body, said hollow lip-like plenum being configured and dimensioned reduce velocity of said heat transfer fluid.

22. The refrigerator of claim 20, wherein said hollow mold body is formed by walls spaced apart by a distance so as to enhance refrigerant flow and heat transfer by increased working fluid velocity.

23. The refrigerator of claim 16, wherein:

said evaporator portion of said hollow tube is in said thermal communication with said mold body via conduction.

24. The refrigerator of claim 16, further comprising a fill cup positioned adjacent said at least one cavity of said mold body in said first position to dispense said water thereto.

25. The refrigerator of claim 16, wherein said heat transfer fluid comprises one of propane, isobutane, and R-134a.

26. The refrigerator of claim 1, further comprising a member which causes said mold body to twist to aid in said discharge of said ice from said at least one cavity.

27. The apparatus of claim 1, further comprising a seal between said mold body and said open end of said hollow tube.

* * * * *

UNITED STATES PATENT AND TRADEMARK OFFICE

CERTIFICATE OF CORRECTION

PATENT NO. : 8,596,084 B2
APPLICATION NO. : 12/857781
DATED : December 3, 2013
INVENTOR(S) : Herrera et al.

It is certified that error appears in the above-identified patent and that said Letters Patent is hereby corrected as shown below:

In the Claims

In Column 11, Line 41, in Claim 14, delete “body” and insert -- body; --, therefor.

Signed and Sealed this
First Day of December, 2015

Michelle K. Lee

Michelle K. Lee
*Director of the United States Patent and Trademark Office*